US006796548B2

(12) United States Patent
Nagata et al.

(10) Patent No.: US 6,796,548 B2
(45) Date of Patent: Sep. 28, 2004

(54) BRAKING DEVICE AND HOISTING MACHINE HAVING SAME

(75) Inventors: Koji Nagata, Aichi (JP); Yukimasa Hisamitsu, Nagoya (JP)

(73) Assignee: Kabushiki Kaisha Meidensha, Tokyo (JP)

( * ) Notice: Subject to any disclaimer, the term of this patent is extended or adjusted under 35 U.S.C. 154(b) by 0 days.

(21) Appl. No.: 10/246,415

(22) Filed: Sep. 19, 2002

(65) Prior Publication Data

US 2003/0062514 A1 Apr. 3, 2003

(30) Foreign Application Priority Data

Sep. 28, 2001 (JP) ..... 2001-302050

(51) Int. Cl.[7] ..... B66D 1/26

(52) U.S. Cl. ..... 254/278; 187/254; 187/351; 188/72.9; 188/73.2; 188/171

(58) Field of Search ..... 254/267, 271, 254/278, 383; 187/254, 350, 351; 188/72.9, 73.2, 166, 171

(56) References Cited

U.S. PATENT DOCUMENTS

| | | | | | |
|---|---|---|---|---|---|
| 1,255,441 | A | * | 2/1918 | Larson | 335/244 |
| 1,314,675 | A | * | 9/1919 | Lilly | 192/140 |
| 1,317,798 | A | * | 10/1919 | Larson | 188/171 |
| 2,529,084 | A | * | 11/1950 | King | 226/77 |
| 4,739,969 | A | * | 4/1988 | Eckersley et al. | 254/378 |
| 5,153,389 | A | * | 10/1992 | Nomura | 187/288 |
| 5,265,701 | A | * | 11/1993 | Ogasawara et al. | 187/254 |
| 5,671,912 | A | * | 9/1997 | Langford et al. | 254/267 |
| 5,697,599 | A | * | 12/1997 | Lamb | 254/328 |
| 5,873,434 | A | * | 2/1999 | Sugita et al. | 187/288 |
| 6,021,872 | A | * | 2/2000 | Sevilleja et al. | 187/350 |
| 6,098,962 | A | * | 8/2000 | Henly | 254/333 |
| 6,520,299 | B2 | * | 2/2003 | Rimann et al. | 188/171 |

FOREIGN PATENT DOCUMENTS

| | | | | |
|---|---|---|---|---|
| EP | 0 970 912 | | 1/2000 | |
| GB | 184790 | | 8/1923 | |
| JP | 6-107387 | * | 6/1994 | 281/351 |
| JP | 2000-16727 | | 1/2000 | |

* cited by examiner

*Primary Examiner*—Emmanuel Marcelo
(74) *Attorney, Agent, or Firm*—Foley & Lardner LLP

(57) ABSTRACT

A braking device includes a brake wheel, a pair of rotation shafts, a pair of brake arms which is rotatably supported through the rotation shafts, a pair of brake pads arranged at one end of the brake arms and contacting and separating from the brake wheel, and a brake part connected to another end of the brake arms for providing and releasing a braking force of the brake pads. When the centers of the rotation shafts are fulcrums, the centers of contact of the brake pads with the brake wheel are points of action, and the connections between the brake arms and the brake part are power points, the fulcrums, the points of action, and the power points are located in a semicircular area of the brake wheel.

10 Claims, 4 Drawing Sheets

43
44
47
52
46
45
53
46a
49
51
50
63
54
51a
48
58
62
A
61
55
56
59
b
d
57
67
e
f
60
c
a

BRAKING DEVICE AND HOISTING MACHINE HAVING SAME

BACKGROUND OF THE INVENTION

The present invention relates to a braking device and a hoisting machine having the braking device, which are suitable for use, particularly, in elevator systems.

An elevator system provided with a hoisting machine is disclosed in P2000-16727A. This elevator system comprises a support arranged at an upper part of a hoistway and a hoisting machine supported thereon. The hoisting machine comprises a sheave on which a rope is wound to support a car.

With the above elevator system, however, there arises a problem that a braking device is increased in size in the radial direction, which causes upsizing of the hoisting machine provided with the braking device. On the other hand, along a recent tendency of elimination of a machine room in the field of elevators, the hoisting machine is often disposed in the hoistway of the elevator system, requiring downsizing of the hoisting machine.

SUMMARY OF THE INVENTION

It is, therefore, an object of the present invention to provide a braking device and a hoisting machine having the braking device, which are reduced in size.

The present invention provides generally an arrangement which comprises: a rotatable brake wheel; a pair of rotation shafts; a pair of brake arms, the brake arms being rotatably supported through the rotation shafts; a pair of brake pads each arranged at one end of the corresponding brake arm, the brake pads contacting and separating from the brake wheel; and a brake part connected to another end of the brake arms, the brake part providing and releasing a braking force of the brake pads, wherein when centers of the rotation shafts are fulcrums, centers of contact of the brake pads with the brake wheel are points of action, and connections between the brake arms and the brake part are power points, the fulcrums, the points of action, and the power points are located in a semicircular area of the brake wheel.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 3:
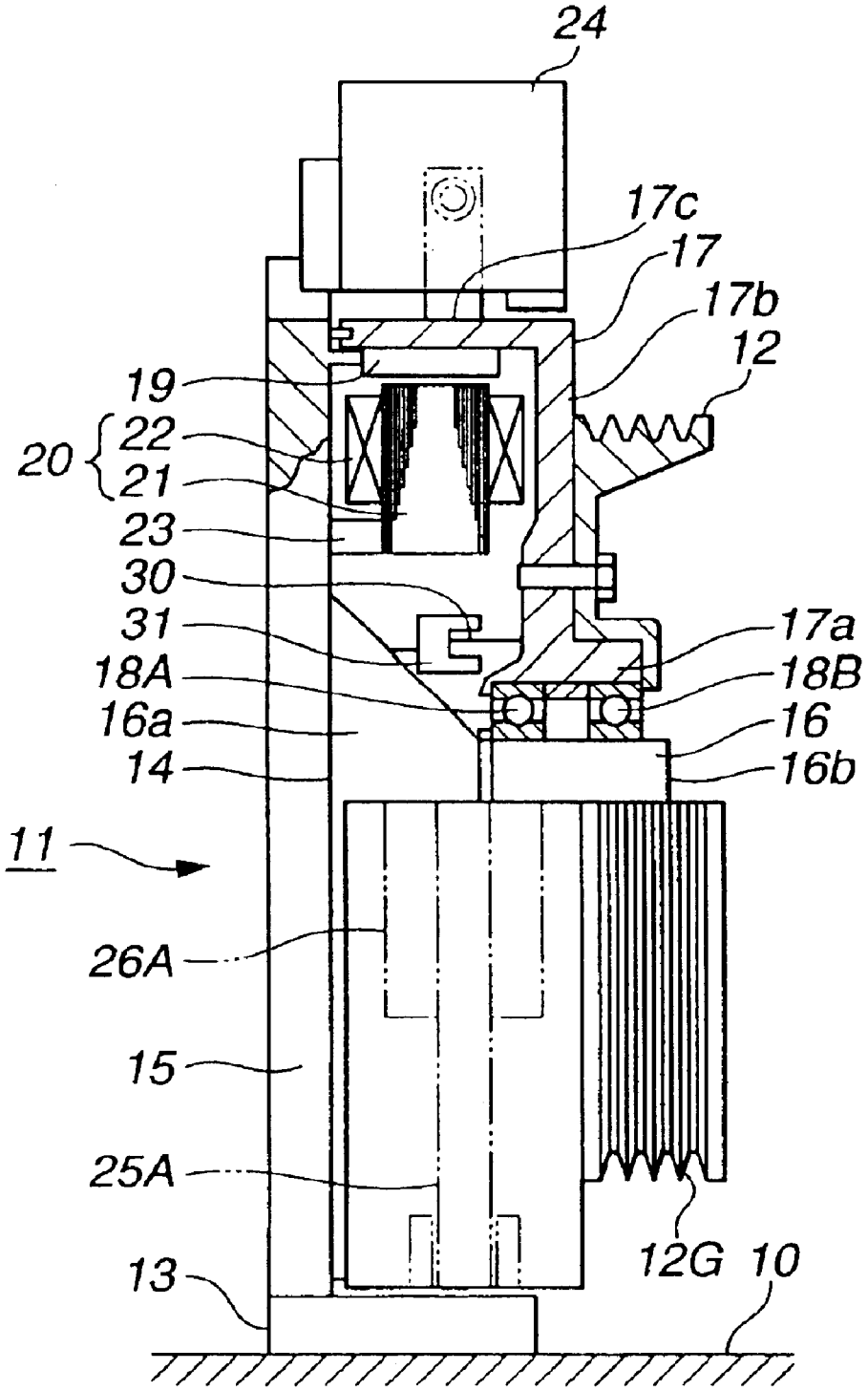
FIG.3 (RELATED ART)
FIG. 3 is a view similar to FIG. 1B, showing a related-art hoisting machine.
Figure 4:
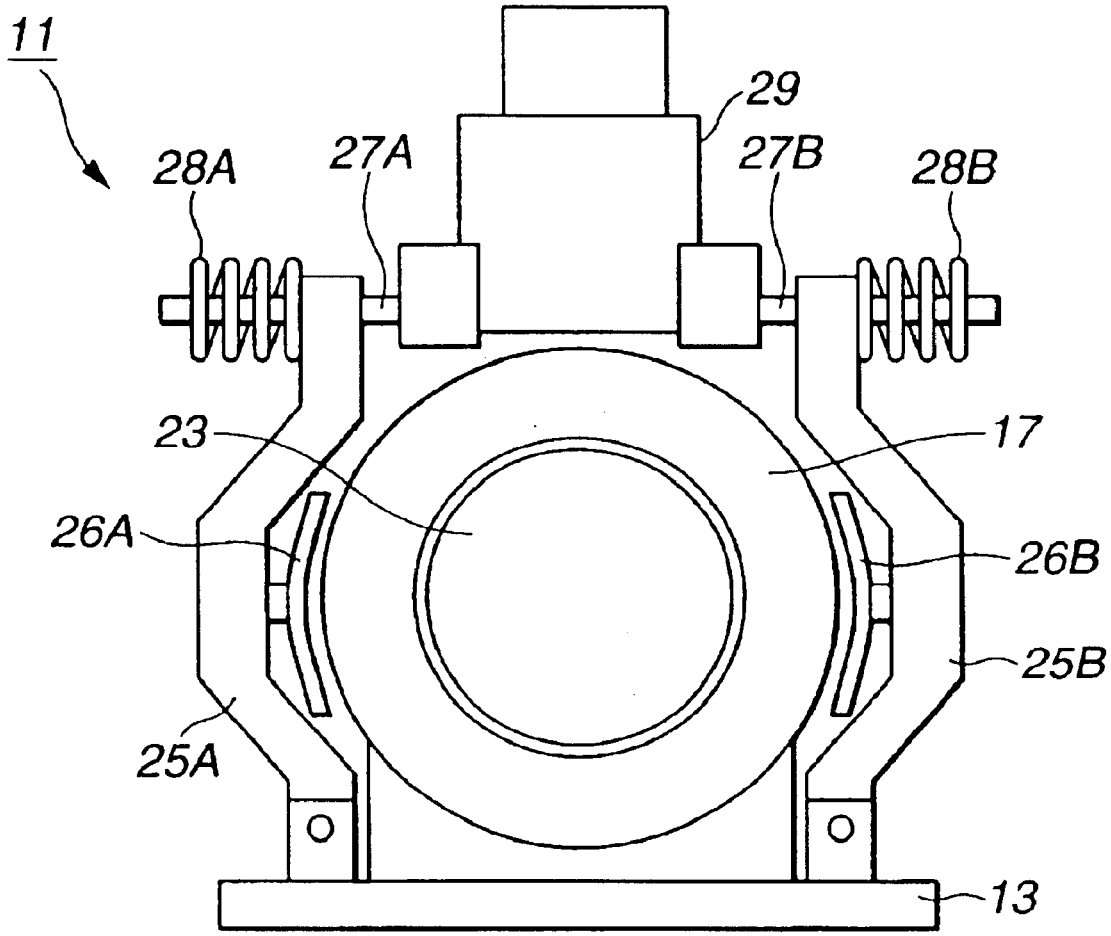
FIG.4 (RELATED ART)
FIG. 4 is a view similar to FIG. 1A, showing the related-art hoisting machine.

Before entering a description about the preferred embodiments of a hoisting machine according to the present invention, the elevator system disclosed in P2000-16727A is described in more detail. Referring to FIGS. 3–4, the elevator system comprises a support 10 arranged at an upper part of a hoistway and a hoisting machine 11 supported thereon. The hoisting machine 11 comprises a sheave 12 on which a rope is wound to support a car.

The hoisting machine 11 comprises essentially a base 13 fixed on the support 10. Specifically, arranged on the base 13 is a stationary frame 15 having a vertical face 14 on which a stationary shaft 16 is supported in an overhang way to extend perpendicularly and then horizontally. The stationary shaft 16 includes a large-diameter portion 16*a* on the fixed-end side and a small-diameter portion 16*b* on the free-end side. A rotary frame 17 is rotatably supported on the small-diameter portion 16*b* through bearings 18A, 18B. The rotary frame 17 is formed like a bottomed cylinder or cup by a disk-like bottom 17*b* having a bearing holder 17*a* and a peripheral wall 17*c* arranged at the circumference of the bottom 17*b*. In order that an opening of the bottomed cylinder may approach the vertical face 14 of the stationary frame 15, the rotary frame 17 is rotatably supported on the small-diameter portion 16*b* of the stationary shaft 16 through the bearings 18A, 18B.

A rotator 19 is supported at the inner periphery of the peripheral wall 17*c* of the rotary frame 17, and a stator 20 having a radial gap with respect to the rotator 19 is fixed to the stationary frame 15. The stator 20 is formed out of a stator core 21 and a stator winding 22 wound thereon, and is fixed to the stationary frame 15 through a bracket 23. The rotator 19, the stator 20, the stationary frame 15 for supporting the stator 20, the rotary frame 17 for supporting the rotator 19, and the stationary shaft 16 for supporting the rotary frame 17 constitute an external-rotation type motor. The sheave 12 is fixed to the outside of the bottom 17*b* of the rotary frame 17, and has a rope groove 12G. A braking device 24 is arranged at the outer periphery of the rotary frame 17, and comprises, as seen in FIG. 4, a pair of brake arms 25A, 25B having one end supported by the base 13, a pair of brake shoes 26A, 26B supported by the brake arms 25A, 25B at the inside of the middle portion to face the outer periphery of the rotary frame 17, a pair of brake shafts 27A, 27B arranged through another ends of the brake arms 25A, 25B to face each other, a pair of brake springs 28A, 28B arranged to bring the brake shafts 27A, 27B closer together, and an electromagnet 29 which operates to separate the brake shafts 27A, 27B against the brake springs 28A, 28B.

A tubular body 30 is arranged with the bottom 17*b* of the rotary frame 17 to be coaxial with the stationary shaft 16. A sensor 31 is supported to enclose a slit formed in the tubular body 30 from both sides thereof, detecting the velocity of the motor.

With the above structure, the rope is moved by driving of the hoisting machine 11 through the sheave 12 to move upward and downward the car in the hoistway. Braking of the hoisting machine 11 is carried out by pressing the brake shoes 26A, 26B on the outer periphery of the rotary frame 17 by a pressing force of the brake springs 28A, 28B.

However, as shown in FIG. 4, the braking device 24 for the hoisting machine 11 is constructed to cover the outer periphery of the rotary frame 17 by a pair of brake arms 25A, 25B having one end supported by the base 13, a pair of brake shoes 26A, 26B supported by the brake arms 25A, 25B at the inside of the middle portion to face the outer periphery of the rotary frame 17, a pair of brake shafts 27A, 27B arranged through another ends of the brake arms 25A, 25B to face each other, a pair of brake springs 28A, 28B arranged to bring the brake shafts 27A, 27B closer together, and an electromagnet 29 which operates to separate the brake shafts 27A, 27B against the brake springs 28A, 28B, raising a problem of upsizing of the braking device 24 in the radial direction with the rotary frame 17 as center. Moreover, upsizing of the braking device 24 causes a problem of upsizing of the hoisting machine 11 provided with such braking device 24.

Figures 1A, 1B:
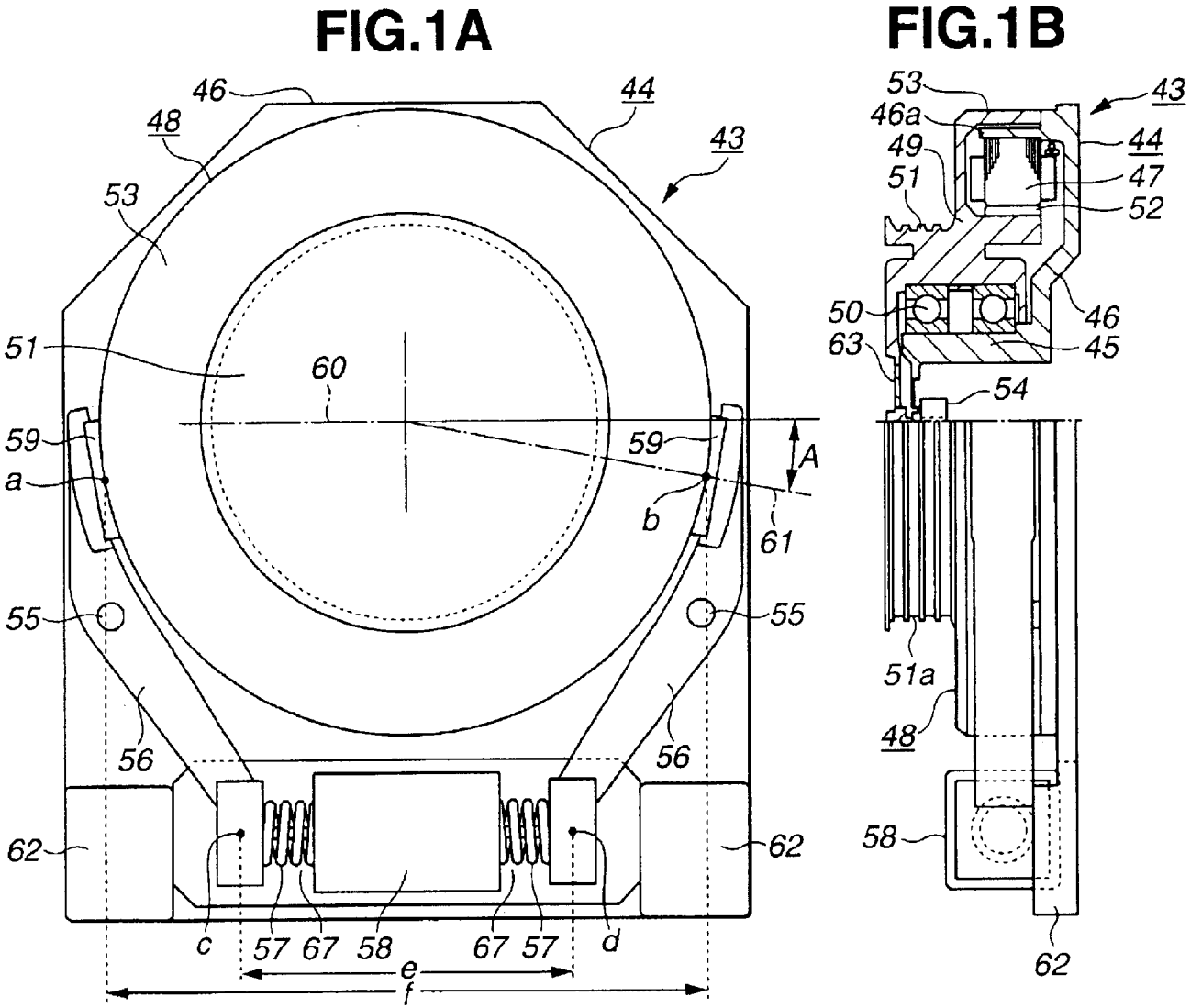
FIG. 1A is a front view showing a first embodiment of a hoisting machine according to the present invention.
FIG. 1B is a side view, half in section, showing the hoisting machine.

Referring to FIGS. 1A–1B, there is shown first embodiment of the present invention. A hoisting machine 43 includes a stationary part 44 and a hollow shank 45. A stationary frame 46 is integrally formed with an end of the shank 45 in which a rotation sensor 54 for sensing the rotational speed of the motor. A rotation-sensor adjusting cover 63 is provided to the shank 46 at an end opposite to the stationary frame 46. A protrusion 46*a* is formed at an outer end of the stationary frame 46 to protrude in the same direction as that of the shank 45. A motor stator 47 is arranged at the inner periphery of the protrusion 46*a*. In such a way, the shank 45, the stationary frame 46, and the motor stator 47 constitute stationary part 44 of the hoisting machine 43.

The hoisting machine 43 includes a rotary part 48. A rotary frame 49 is disposed to face the stationary frame 46, and is rotatably supported to the shank 45 through a bearing 50. A sheave 51 is integrally formed with the rotary frame 49 on the side opposite to the stationary frame 46, and has a rope groove 51*a* formed at the outer periphery. A rope is wound on the rope groove 51*a* to suspend a car which moves upward and downward in a hoistway. A motor rotator 52 comprising a permanent magnet is arranged at the outer periphery of the rotary frame 49 to face the inner periphery of the motor stator 47. Moreover, a brake wheel 53 is integrally formed with the rotary frame 49 to protrude from the outer periphery thereof. Therefore, the brake wheel 53 is larger in diameter than the rotary fame 49 and the sheave 51. The rotary frame 49, the sheave 51, the motor rotator 52, and the brake wheel 53 constitute rotary part 48 of the hoisting machine 43.

A pair of brake arms 56 is rotatably supported to the stationary frame 46 through rotation shafts 55, and has one end to which one end of a pair of facing brake shafts 67 is coupled. A brake spring 57 for providing a braking force is arranged around the brake shaft 67. Another end of the brake shaft 67 is inserted in an electromagnet 58 which operates to release a braking force of the brake spring 57. The brake shaft 67, the brake spring 57, and the electromagnet 58 constitute a brake part. All of the brake arms 56, the brake shafts 67, the brake springs 57, and the electromagnet 58 are arranged below a horizontal center line 60 of the brake wheel 53. Brake pads. 59 have a center line 61 positioned below the center line 60 by an angle A. Specifically, when the centers of the rotation shaft 55 are fulcrums, centers of contact "a", "b" of the brake pads 59 with the brake wheel 53 are points of action, and connections "c", "d" between the brake arms 56 and the brake shafts 67 are power points, the fulcrums, the points of action, and the power points are located below the center line 60 of the brake wheel 53.

When a distance between the power points "c", "d" is "e", and a distance between the points of action "a", "b" is "f", the distance "e" is smaller than the distance "f" (e<f). Terminal boxes 62 are arranged on the stationary frame 46 at the side of the power points "c", "d" to carry out electrical connection between the outside and the motor stator 47 and electromagnet 58.

With the above structure, when energizing the motor stator 47, the sheave 51 integrated with the rotary frame 49 is rotated to move upward and downward the car in the hoistway through the rope. During rotation of the sheave 51, the electromagnet 58 is also energized to release braking by the brake springs 57. When braking the sheave 51, energization of the electromagnet 58 is stopped, and the brake pads 59 are pressed against the brake wheel 53 by a biasing force of the brake springs 57.

In the first embodiment, the brake wheel 53 is separated by the horizontal center line 60 to arrange the fulcrums, the points of action, and the power points of the braking device only in the lower outer peripheral portion of the brake wheel 53, allowing downsizing of the braking device and also the hoisting machine 43 using this device. Moreover, with the braking device, since the distance "e" between the power points "c", "d" is smaller than the distance "f" between the points of action "a", "b", the brake arms 56 are disposed along the outer periphery of the brake wheel 53, allowing further downsizing of the braking device. Further, the terminal boxes 62 for the hoisting mechanism 43 are arranged at the side of the power points "c", "d", i.e. at the side of the brake part of the braking device, allowing further downsizing of the hoisting mechanism 43 and easy wiring work and maintenance for the terminal boxes 62.

The shank 45 for sustaining rotary motion, the stationary frame 46 integrated with the shank 45, and the motor stator 47 provided to the stationary frame 46 constitute stationary part 44 of the hoisting machine 43, whereas the rotary frame 49 rotatably supported to the shank 45, the sheave 51 integrated with the rotary frame 49, the brake wheel 53 integrated with the outer periphery of the rotary frame 49 and having larger diameter than that of the sheave 51, the motor rotator 52 arranged at the outer periphery of the rotary frame 49 constitute rotary part 48 of the hoisting machine 43. This allows simple and thin structure of the hoisting machine 43, leading to suitable application to the elevator systems with a machine room eliminated.

Figure 2:
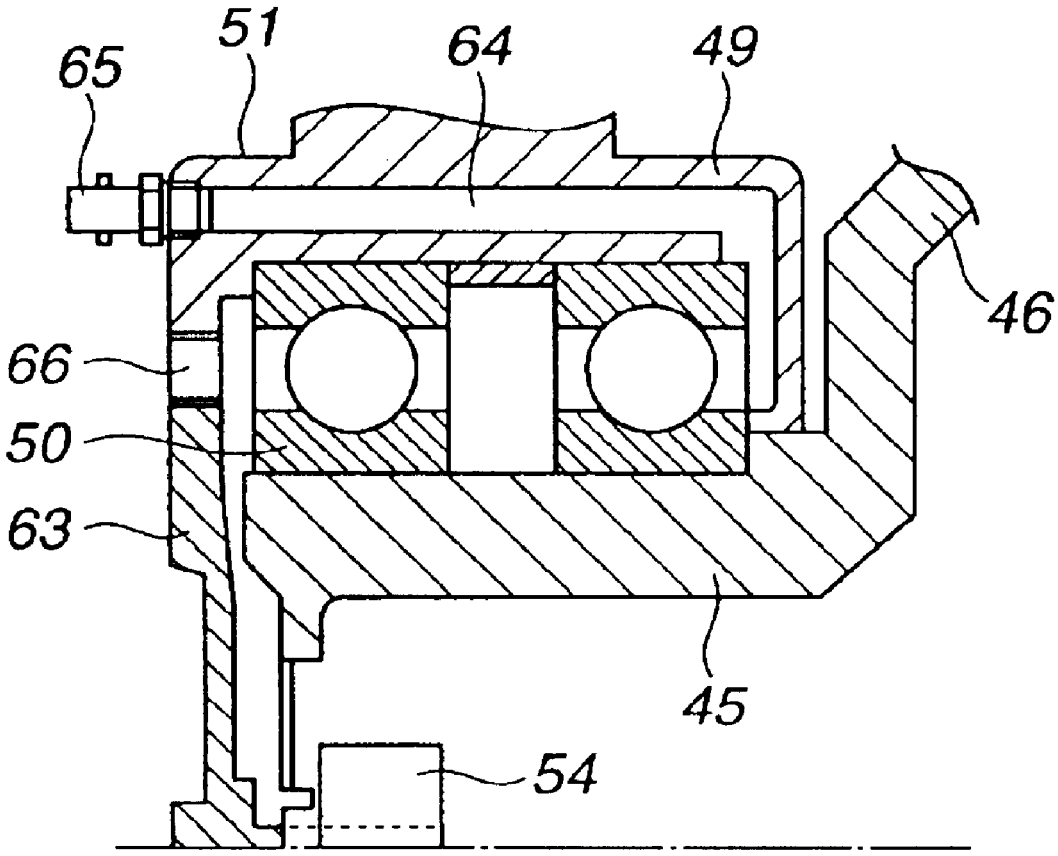
FIG. 2 is a fragmentary section showing a second embodiment of the present invention.

Referring to FIG. 2, there is shown second embodiment of the present invention. A grease passage 64 is formed in the sheave 51 and the rotary frame 49 around the bearing 50. A grease supply port 65 is provided to the grease passage 64 on the side of the sheave 51, and a grease discharge port 66 is provided to the bearing 50 on the side of the sheave 51. As a result, grease supply to the bearing 50 can be carried out from the side of the sheave 51, facilitating grease supply and change.

Having described the present invention in connection with the preferred embodiments, it is noted that the present invention is not limited thereto, and various modifications and changes can be made without departing the scope of the present invention.

The entire teachings of Japanese Patent Application P2001-302050 filed Sep. 28, 2001 are incorporated hereby by reference.

What is claimed is:

1. An arrangement, comprising:

a rotatable brake wheel;

a pair of rotation shafts;

a pair of brake arms, the brake arms being rotatably supported through the rotation shafts;

a pair of brake pads each arranged at one end of the corresponding brake arm, the brake pads contacting and separating from the brake wheel;

a brake part connected to another end of the brake arms, the brake part providing and releasing a braking force of the brake pads;

a sheave on which a rope is wound, the rope supporting an object to be supported; and a stationary part and a rotary part, the stationary part comprising a shank, a stationary frame integrally formed with the shank, and a motor rotator provided to the stationary frame, the rotary part comprising a rotary frame rotatably supported to the shank through a bearing to face the stationary frame, the sheave integrally formed with the rotary frame on the side opposite to the stationary frame, a motor rotator arranged at an outer periphery of the rotary frame to face the motor stator, and the brake wheel integrally formed with an outer periphery of the rotary frame and having larger diameter than that of the sheave, and wherein, when centers of the rotation shafts are fulcrums, centers of contact of the brake pads with the brake wheel are points of action, and connections between the brake arms and the brake part are power points, the fulcrums, the points of action, and the power points being located in a lower semicircular area of the brake wheel.

2. The arrangement as claimed in claim 1, wherein a distance between the power points is smaller than a distance between the points of action.

3. The arrangement as claimed in claim 1, wherein the sheave is integrally formed with the brake wheel.

4. The arrangement as claimed in claim 1, further comprising terminal boxes arranged at the side of the power points, the terminal boxes carrying out electric connection to the outside.

5. The arrangement as claimed in claim 1, wherein the lower semicircular area of the brake wheel corresponds to an area below a horizontal center line of the brake wheel.

6. A braking device, comprising:

a rotatable brake wheel;

a pair of rotation shafts;

a pair of brake arms, the brake arms being rotatably supported through the rotation shafts;

a pair of brake pads each arranged at one end of the corresponding brake arm, the brake pads contacting and separating from the brake wheel;

a brake part connected to another end of the brake arms, the brake part providing and releasing a braking force of the brake pads;

a sheave on which a rope is wound, the rope supporting an object to be supported; and a stationary part and a rotary part, the stationary part comprising a shank, a stationary frame integrally formed with the shank, and a motor rotator provided to the stationary frame, the rotary part comprising a rotary frame rotatably supported to the shank through a bearing to face the stationary frame, the sheave integrally formed with the rotary frame on the side opposite to the stationary frame, a motor rotator arranged at an outer periphery of the rotary frame to face the motor stator, and the brake wheel integrally formed with an outer periphery of the rotary frame and having larger diameter than that of the sheave, wherein, when centers of the rotation shafts are fulcrums, centers of contact of the brake pads with the brake wheel are points of action, and connections between the brake arms and the brake part are power points, the fulcrums, the points of action, and the power points being located in a lower semicircular area of the brake wheel, and a distance between the power points being smaller than a distance between the points of action.

7. The braking device as claimed in claim 6, wherein the lower semicircular area of the brake wheel corresponds to an area below a horizontal center line of the brake wheel.

8. A hoisting machine with a braking device, the braking device comprising:

a rotatable brake wheel;

a pair of rotation shafts;

a pair of brake anus, the brake arms being rotatably supported through the rotation shafts;

a pair of brake pads each arranged at one end of the corresponding brake arm, the brake pads contacting and separating from the brake wheel;

a brake part connected to another end of the brake arms, the brake part providing and releasing a braking force of the brake pads; and a stationary part and a rotary part, wherein the stationary part comprising a shank, a stationary frame integrally formed with the shank, and a motor rotator provided to the stationary frame, the rotary part comprising a rotary frame rotatably supported to the shank through a bearing to face the stationary frame, a sheave integrally formed with the rotary frame on the side opposite to the stationary frame, a motor rotator arranged at an outer periphery of the rotary frame to face the motor stator, and the brake wheel integrally formed with an outer periphery of the rotary frame and having larger diameter than that of the sheave, wherein, when centers of the rotation shafts are fulcrums, centers of contact of the brake pads with the brake wheel are points of action, and connections between the brake arms and the brake part are power points, the fulcrums, the points of action, and the power points being located in a lower semicircular area of the brake wheel, and wherein a rope is wound around the sheave, the rope supporting an object to be supported, the sheave being integrally formed with the brake wheel.

9. The hoisting machine as claimed in claim 8, further comprising terminal boxes arranged at the side of the power points, the terminal boxes carrying out electric connection to the outside.

10. The hoisting machine as claimed in claim 8, wherein the lower semicircular area of the brake wheel corresponds to an area below a horizontal center line of the brake wheel.

* * * * *